US006742205B2

(12) United States Patent
Dewert

(10) Patent No.: US 6,742,205 B2
(45) Date of Patent: Jun. 1, 2004

(54) ADJUSTABLE PADDING DEVICE FOR A PIECE OF FURNITURE USED FOR SITTING AND/OR LYING UPON

(75) Inventor: Eckhart Dewert, Zürich (CH)

(73) Assignee: Cimosys AG, Goldingen (CH)

( * ) Notice: Subject to any disclaimer, the term of this patent is extended or adjusted under 35 U.S.C. 154(b) by 0 days.

(21) Appl. No.: 10/176,616

(22) Filed: Jun. 24, 2002

(65) Prior Publication Data

US 2002/0152552 A1 Oct. 24, 2002

Related U.S. Application Data

(63) Continuation of application No. PCT/EP00/13082, filed on Dec. 21, 2000.

(30) Foreign Application Priority Data

Dec. 23, 1999 (DE) ..... 199 62 537

(51) Int. Cl.[7] ..... A61G 7/015; A47C 17/04

(52) U.S. Cl. ..... 5/618; 5/616; 5/236.1; 5/722

(58) Field of Search ..... 5/618, 617, 616, 5/613, 236.1, 722

(56) References Cited

U.S. PATENT DOCUMENTS

| | | | | |
|---|---|---|---|---|
| 3,051,965 A | * | 9/1962 | Szemplak et al. | 5/616 |
| 3,300,794 A | | 1/1967 | Altorfer | 5/616 |

(List continued on next page.)

FOREIGN PATENT DOCUMENTS

| | | |
|---|---|---|
| CH | 607 682 | 10/1978 |
| DE | 32 182 78 A1 | 11/1983 |
| DE | 38 42 078 C2 | 7/1992 |
| DE | 195 00 185 A1 | 7/1996 |
| DE | 195 03 650 A1 | 8/1996 |
| DE | 195 42 321 A1 | 5/1997 |
| DE | 297 01 084 U1 | 7/1997 |
| DE | 299 07 850 U1 | 10/1999 |
| DE | 200 00 700 U1 | 5/2000 |
| EP | 0 373 912 | 6/1990 |
| EP | 0 372 032 B1 | 5/1992 |
| EP | 0 568 957 A1 | 11/1993 |
| EP | 0 583 660 A1 | 2/1994 |
| EP | 0 721 754 A1 | 7/1996 |
| EP | 0 873 709 A1 | 10/1998 |
| EP | 0 884 011 A1 | 12/1998 |
| EP | 0 935 937 A1 | 8/1999 |
| WO | 91/01099 | 2/1991 |
| WO | 92/09520 | 6/1992 |
| WO | 99/42021 | 8/1999 |

OTHER PUBLICATIONS

Internationaler Recherchenbericht (PCT) Artikel 18 sowie Regeln 43 und 44 PCT, Internationales Anmeldedatum Dec. 21, 2000, Internationales Aktenzeichen PCT/EP 00/13082 (4 pgs).

PCT (Kapitel II) Antrag Auf Internationale Vorlaufigg Prufung, Internationales Aktenzeichen PCT/EP 00/13082, Internationales Anmeldedatum 21/21/2000 (3 pgs).

PCT Schriftlicher Bescheid (Regel 66 PCT) for PCT/EP00/13082, filed Dec. 21, 2000 dated Jan. 22, 2002 (6 pgs).

*Primary Examiner*—Robert G. Santos
(74) *Attorney, Agent, or Firm*—Shlesinger, Arkwright & Garvey LLP

(57) ABSTRACT

An adjustable padding device for a piece of furniture used for sitting and/or lying upon. The device comprises at least one flat elastically deformable padding element and at least one adjustable supporting device with a base body for supporting the padding element in a flat manner. Adjusting element(s) are provided on the supporting device that are used to adjust the inclination and/or height of at least one part of the supporting device, whereby the padding element is attached to the supporting device and to the adjusting element(s) to form a unit.

23 Claims, 5 Drawing Sheets

U.S. PATENT DOCUMENTS 3,447,170 A * 6/1969 Spitz ..... 5/722
3,717,376 A * 2/1973 Lutchansky ..... 5/236.1 X
3,868,103 A 2/1975 Pageot et al. ..... 5/614
4,258,445 A * 3/1981 Zur ..... 5/614
4,336,621 A * 6/1982 Schwartz et al. ..... 5/722
4,349,924 A * 9/1982 Zur ..... 5/618
4,381,571 A 5/1983 Elliott ..... 5/616
4,463,463 A 8/1984 Kaneko ..... 5/616
4,559,656 A * 12/1985 Foster ..... 5/236.1
4,589,151 A * 5/1986 Behrens ..... 5/236.1 X
4,800,599 A 1/1989 Korchinski et al. ..... 5/618
4,928,332 A * 5/1990 Ogden et al. ..... 5/614
5,063,623 A 11/1991 Bathrick et al. ..... 5/616
5,490,298 A 2/1996 Goldsmith et al. ..... 5/611
5,491,854 A 2/1996 Music ..... 5/618
5,537,701 A * 7/1996 Elliott ..... 5/618 X
5,542,744 A 8/1996 Bathrick ..... 297/362.11
5,544,376 A * 8/1996 Fromson ..... 5/618
5,577,280 A * 11/1996 Elliott ..... 5/618
5,640,730 A * 6/1997 Godette ..... 5/618
5,675,849 A 10/1997 Koch ..... 5/616
5,687,437 A 11/1997 Goldsmith ..... 5/611
5,740,568 A 4/1998 Elliott ..... 5/620
5,870,784 A * 2/1999 Elliott ..... 5/618
5,916,086 A * 6/1999 Rossdeutscher ..... 5/236.1
5,926,872 A * 7/1999 Rossdeutscher ..... 5/236.1
5,926,877 A 7/1999 Lin ..... 5/618
6,006,379 A * 12/1999 Hensley ..... 5/618
6,061,852 A * 5/2000 Bathrick et al. ..... 5/618
6,079,065 A * 6/2000 Luff et al. ..... 5/618
6,088,853 A 7/2000 Jansen ..... 5/618
6,101,647 A * 8/2000 Stroud et al. ..... 5/618
6,105,187 A 8/2000 Gnjatovic ..... 5/618
6,209,157 B1 4/2001 Hensley ..... 5/618
6,209,707 B1 4/2001 Ronchi ..... 198/445
6,311,348 B1 11/2001 Luff et al. ..... 5/618
6,393,641 B1 5/2002 Hensley ..... 5/618
6,679,555 B2 * 1/2004 Bangert ..... 297/316
6,687,932 B1 * 2/2004 Bangert et al. ..... 5/617
2001/0000828 A1 * 5/2001 Hensley ..... 5/618
2002/0152552 A1 * 10/2002 Dewert ..... 5/618
2002/0162170 A1 11/2002 Dewert ..... 5/617
2003/0052238 A1 3/2003 Schneider ..... 248/157
2003/0079290 A1 5/2003 Dewert ..... 5/618
2003/0106154 A1 * 6/2003 Takeuchi ..... 5/618
2003/0208845 A1 * 11/2003 Heaton ..... 5/618
2004/0034934 A1 * 2/2004 Weinman et al. ..... 5/618

* cited by examiner

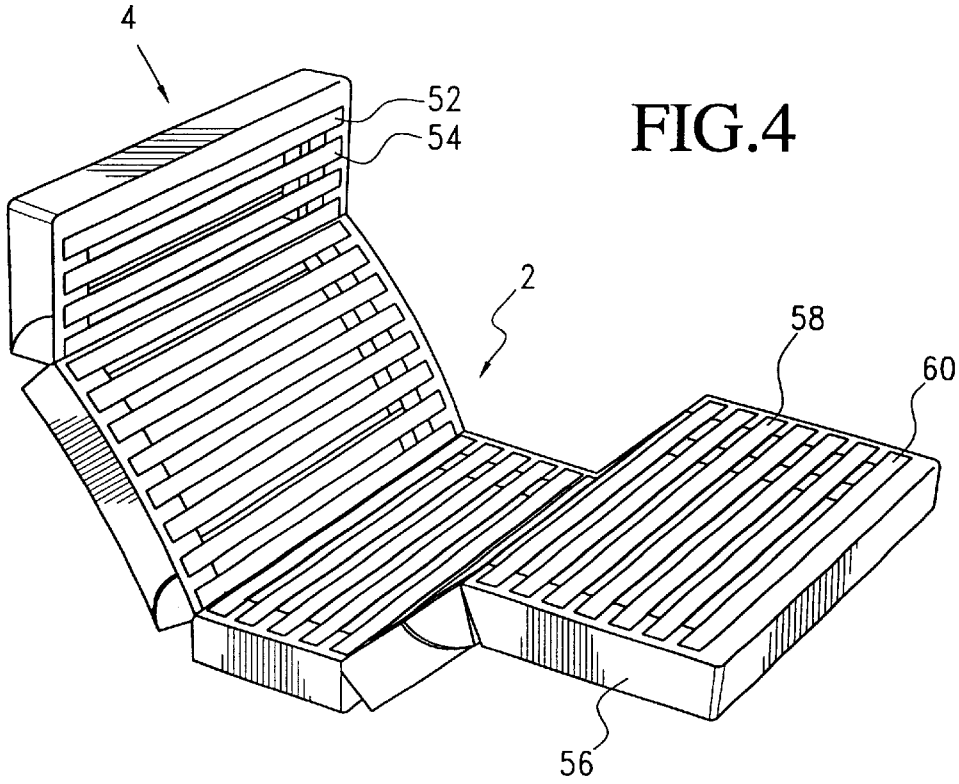
FIG.4
FIG.5
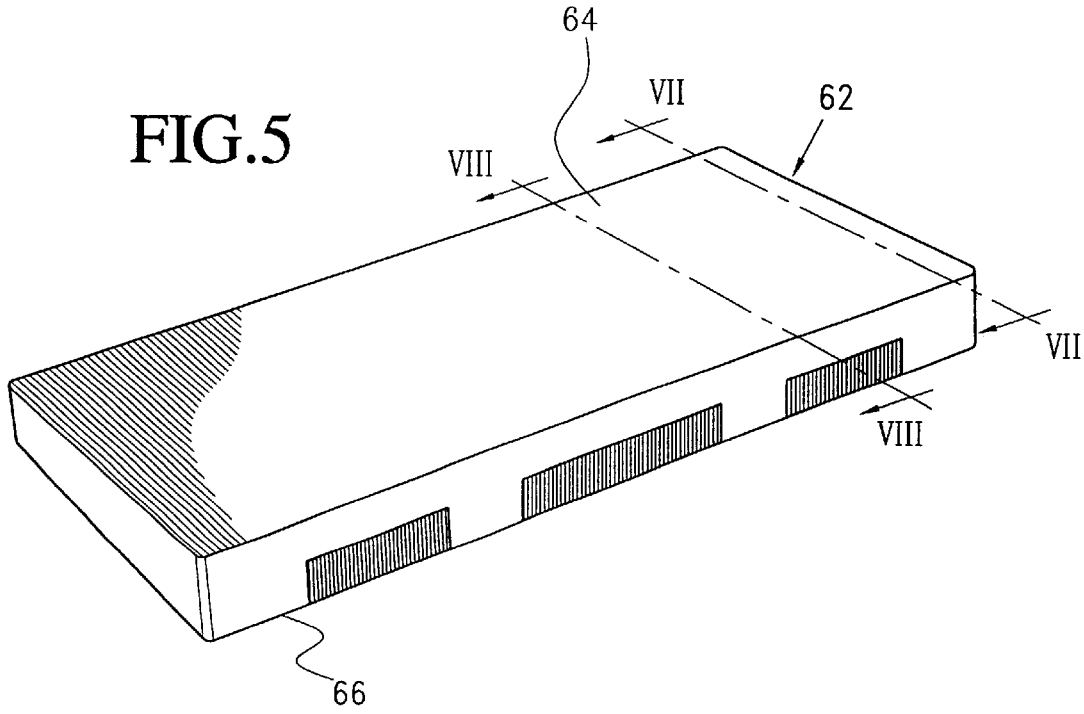

ADJUSTABLE PADDING DEVICE FOR A PIECE OF FURNITURE USED FOR SITTING AND/OR LYING UPON

CROSS REFERENCE TO RELATED APPLICATIONS

This application is a continuation of Application No. PCT/EP00/13082, filed Dec. 21, 2000, which claims priority of German Application No. 199 62 537.9, filed Dec. 23, 1999, and each of which is incorporated herein by reference.

This application relates to assignee's co-pending application Ser. No. 10/176,615, filed Jun. 24, 2002, and to assignee's co-pending application Ser. No. 10/177,750, filed Jun. 24, 2002.

FIELD OF THE INVENTION

The invention relates to an adjustable padding device for a piece of furniture used for sitting and/or lying upon.

BACKGROUND OF THE INVENTION

Padding devices for a piece of furniture used for sitting and/or lying upon are generally known, for example, in the form of a combination of a separate mattress with a separate slatted frame. A disadvantage of this known combination of slatted frame and mattress exists in that, as a rule, the slatted frame does not match the mattress in its suspension properties. This results in a loss of comfort for the user.

Furthermore, adjustable slatted frames are known, which may include adjusting means for adjusting at least one part of the slatted frame in its inclination and/or its height. These slatted frames are, however, also used with separate mattresses so that, in turn, it is not possible to match the mattress to the slatted frame and this likewise results in a loss of comfort for the user.

OBJECTS AND SUMMARY OF THE INVENTION

The invention is based on the object of providing a padding device for a piece of furniture used for sitting and/or lying upon, in which the comfort and ergonomic characteristics are improved.

This object is achieved by the an adjustable padding device for a piece of furniture used for one of sitting and lying upon, including at least one flat, elastically deformable padding element. At least one adjustable supporting device, the adjustable supporting device including a base frame for flat support of the at least one deformable padding element. The at least one padding element being attached to the supporting device to form a unit, an electromotive adjusting element arranged on the supporting device for adjusting at least one part of the supporting device in one of its inclination and its height, and the electromotive adjusting element being integrated into the unit made of the at least one adjustable padding element and the supporting device.

The basic idea of the teaching according to the invention comprises attaching the padding element, for example, a mattress, to the supporting device, for example a slatted frame, and to the adjusting means to form a unit. In this manner, an optimal adaptation of the supporting device to the padding element is facilitated, thereby improving the comfort for the user. The thickness of the padding element may be chosen, for example, such that the suspension properties of the padding device are determined mainly by the suspension properties of the supporting device. Moreover, the padding element may be adapted to the adjusting possibilities of the supporting device.

Since the padding element is attached to the supporting device, transport and handling with respect to conventional padding devices, in which the padding element and the supporting device are designed as separate units, are considerably simplified.

The padding device according to the invention is simple and can be manufactured at a reasonable price and is versatile.

The attachment of the padding element to the supporting device and to the adjusting means to form a unit may be accomplished, for example, by attaching the or each padding element to the supporting device in a detachable manner, and by providing the holding means for holding the or each padding element to the supporting device, as a suitable development of the teaching according to the invention provides. In this case, the holding means may be designed in any suitable manner.

A particularly advantageous development of the teaching according to the invention provides for the or each padding element to be firmly attached to the supporting device. In this manner, the structure of the padding device according to the invention is designed in a particularly simple manner. The padding element and the supporting device may be firmly connected to one another in any suitable manner during the manufacture of the padding device according to the invention.

A development of the aforementioned embodiment provides for the or each padding element to be glued or foamed onto the supporting device. In this embodiment, the manufacture of the padding device according to the invention is simplified further.

Another development of the teaching according to the invention provides for the adjusting means to be arranged substantially completely between an upper delimiting plane and a lower delimiting plane of the supporting device. In this manner, the adjusting means do not project beyond the supporting device, so that only a slight overall height of the supporting device, and consequently, also of the padding device, results.

The adjusting means may be designed in any suitable manner. Suitably, the adjusting means may include at least an electromotive adjusting driving gear, in particular at least a linear driving gear. Linear driving gears, in particular, are available as simple, reasonably priced and robust standard components, so that the padding device according to the invention is altogether reasonably priced and robustly designed.

Another embodiment of the teaching according to the invention provides for the base frame to include longitudinal beams at a distance to one another, and at its ends in longitudinal direction, crossbars, and for the longitudinal beams and/or the crossbars, on its side facing the padding element, to include bearing areas made of an elastic material, on which the padding element lies. Through appropriate selection of the elastic material, the suspension properties of the padding device may be influenced.

In the aforementioned embodiment, the bearing areas are suitably designed strip-shaped.

Another suitable embodiment provides for the base frame to include on its side facing the padding element springy slats at a distance to one another, particularly made of wood, on which the padding element lies. In this embodiment, the supporting device is configured like a slatted frame.

An extraordinarily advantageous development of the embodiments with the bearing areas and the slats provides for recesses to be formed in the bearing areas, into which the slats engage with their free ends. In this embodiment, the slats are held between the base frame of the supporting device and the padding element so that separate holding means for holding the slats to the base frame are not necessary. This simplifies the design of the padding device and makes its manufacture more reasonably priced.

In the aforementioned embodiment, the recesses are advantageously shaped in a substantially complementary manner to the free ends of the slats, so that the slats are held in an interlocking manner in the recesses.

Another suitable development of the embodiments with the bearing areas and the slats provides for the areas of the free ends of the slats facing the padding element to substantially align with the adjacent bearing areas. In this embodiment, the ends of the slats with the adjacent bearing areas form a continuous bearing area for the padding element, which for example may be glued to this continuous bearing area, and may consequently be securely attached to the supporting device.

It is basically possible to provide elastic material between the slats and the longitudinal beams of the base frame, and in such a way, influence the suspension properties of the padding element. However, the slats suitably lie on the longitudinal beams of the base frame so that the longitudinal beams form the support for the slats and the suspension properties of the padding device are consequently solely dependent on the suspension properties of the slats and of the padding element.

In the embodiment with the bearing areas made of elastic material, the elastic material is suitably a synthetic foam, as an embodiment provides. This further simplifies the manufacture of the padding device according to the invention.

The longitudinal beams and/or the crossbars may also be wrapped with the synthetic foam, as an embodiment provides.

The shape, size and design of the base frame of the supporting device are to a large extent selectable. The base frame of the supporting device suitably may include a first supporting part and at least a second supporting part for flat support of the padding element, the first supporting part and the second supporting part being attached to one another with a hinge and being pivotable relative to one another through the adjusting means. In this embodiment, the first supporting part and the second supporting part are adjustable to one another in their inclination.

A suitable development of the aforementioned embodiment provides for the first supporting part to be formed by a middle supporting part and for the second supporting part to be formed by an upper body supporting part, and for a leg supporting part to be provided, which is attached with a hinge to the middle supporting part on its side away from the upper body supporting part and is attached pivotably around a swivel pin substantially parallel to the swivel pin of the upper body supporting part. This embodiment facilitates an adjustment of the padding device in the upper body area as well as in the leg area of a user, thereby improving the ergonomics.

A development of the aforementioned embodiment provides for a head supporting part, which is attached with a hinge to the upper body supporting part on its side away from the middle supporting part and is attached pivotably around a swivel pin substantially parallel to the swivel pin of the head supporting part. Another development provides for a calf supporting part, which is attached with a hinge to the leg supporting part on its side away from the middle supporting part and is attached pivotably around a swivel pin substantially parallel to the swivel pin of the leg supporting part. In the two aforementioned forms of embodiment, the ergonomics is further improved in that additional adjustment possibilities are created in the region of the head and/or of the calf of the user.

The padding element with the supporting device and the adjusting means is advantageously accommodated in a common casing, which preferably substantially completely surrounds the unit made of the padding element and the supporting device with the adjusting means. In this manner, the supporting device and the adjusting means are completely covered and are no longer visible. The padding device according to the invention thereby imparts the optical impression of a conventional mattress without an adjustable slatted frame.

A development of the aforementioned embodiment provides for the casing to include at least one sealable opening, such that the adjusting means are accessible through the opening or the openings. This facilitates maintenance of the adjusting means or the replacement of parts in the event of a defect.

It is basically possible to stitch up, and if required, to undo the seam of the opening or openings, for example. The opening is or the openings are suitably sealable through a zipper, a hook-and-loop (e.g., Velcro®) fastener, or the like. This facilitates, if requires, the access to the adjusting means and facilitates in a simple manner a resealing of the openings.

The casing may be made of any suitable material. The casing is suitably formed by a cover made of a textile material, as a development provides. In this manner, an absorption of moisture by the padding element is made possible and the padding device according to the invention is consequently designed to breathe.

The shape, size, and design of the padding element according to the invention are to a large extent selectable. Depending on the use, several padding elements may also be provided. If the piece of furniture used for sitting and/or lying upon is a bed or a couch, it is suitable for the padding element to be a mattress, as an embodiment provides.

A piece of furniture used for sitting and/or lying upon provided with a padding device according to the invention may include any of the padding devices or elements described herein.

The invention will be explained more precisely in the following with the help of the attached drawings.

BRIEF DESCRIPTION OF THE DRAWINGS

FIG. 4 shows in the same manner as in FIG. 3, the base frame according to FIG. 3, whereby the supporting parts of the supporting device are adjusted relative to one another;

FIG. 5 shows in a schematic perspective view, an embodiment of the padding device according to the invention, whereby the supporting device with the adjusting means and the padding element are accommodated in a casing in the form of a case, and whereby the supporting parts of the supporting device are not adjusted relative to one another;

In the figures of the drawing, the same or corresponding components are provided with the same reference numbers.

Relative terms such as up, down, lengthwise, transverse, left and right are for convenience only and are not intended to be limiting.

DETAILED DESCRIPTION OF THE DRAWINGS

Figure 1:
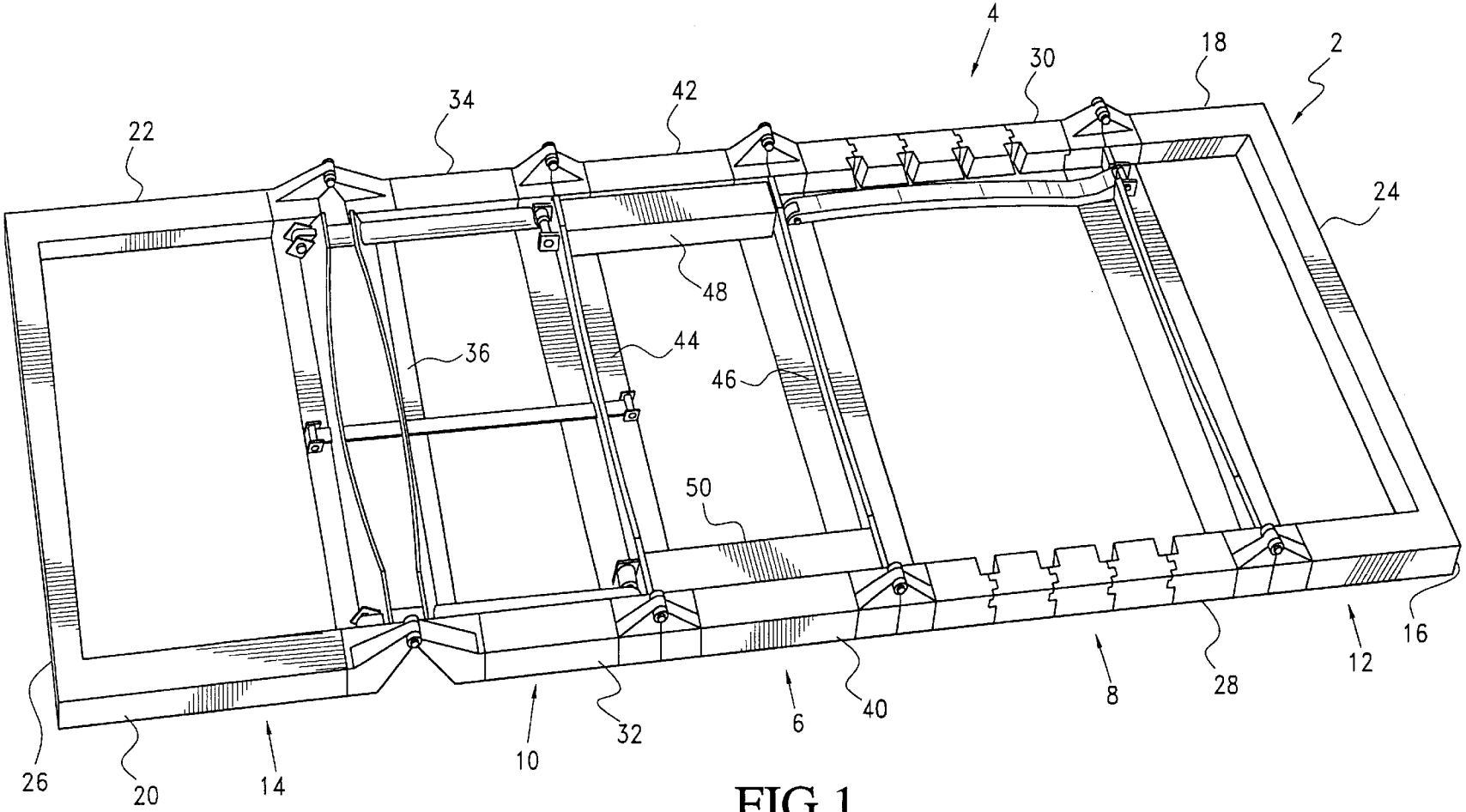
FIG. 1 shows in a schematic perspective view, a base frame of an embodiment of a supporting device of a padding device according to the invention, whereby the supporting parts of the supporting device are not adjusted relative to one another.

In FIG. 1, a base frame 2 of a supporting device 4 of a padding device according to the invention is shown, the supporting device being designed as slatted frames with slats not shown in FIG. 1, whereby the supporting device 4 may include in its longitudinal direction, consecutive supporting parts for flat support of a padding element designed in this embodiment as a mattress, not shown in FIG. 1.

In particular, the supporting device 4 may include a first supporting part, which forms a middle supporting part 6, with which an upper body supporting part 8 is attached with a hinge on one side and attached pivotably around a horizontal swivel axis, and a leg supporting part 10 attached with a hinge to the side away from the upper body supporting part 8 and attached pivotably around a horizontal swivel axis.

With the upper body supporting part 8, attached with a hinge on its side away from the middle supporting part and attached pivotably around a horizontal swivel axis, is a head supporting part 12, and with the leg supporting part 10, attached with a hinge on its side away from the middle supporting part 6 and attached pivotably around a horizontal swivel axis, is a calf supporting part 14.

The head supporting part 12 and the calf supporting part 14 each may include longitudinal beams 16, 18 and 20, 22 respectively, each of which are attached to one another via a crossbar 24 and 26 respectively.

The upper body supporting part 8 and the leg supporting part 10 each may include longitudinal beams 28, 30, and 32, 34 respectively, each of which are attached to one another via crossbars 36, 38.

The middle supporting part 6 may include longitudinal beams 40, 42, which are attached to one another via crossbars 44, 46.

Adjusting means for adjusting the supporting parts 6, 8, 10, 12, 14 relative to one another are provided on the base frame 2 of the supporting device 4. In this embodiment, the adjusting means may include two electromotive linear driving gears 48, 50, whereby the linear driving gear 48 is attached to the upper body supporting part 8 and the head supporting part 10 via an operating mechanism, not of further importance here, in such a way that the upper body supporting part 8 relative to the middle supporting part 6 and the head supporting part 12 relative to the upper body supporting part 8 are pivotable around the respective swivel axis and consequently adjustable in their inclination. The linear driving gear 50 is attached to the leg supporting part 10 and the calf supporting part 14 via an operating mechanism, likewise not of further importance here, in such a way that the leg supporting part 10 relative to the middle supporting part 6 and the calf supporting part 14 relative to the leg supporting part 10 are pivotable, and as a result, adjustable in their inclination.

The linear driving gears 48, 50 are accommodated between an upper delimiting plane running through the upper sides of the longitudinal beams 40, 42 of the middle supporting part 6 and a lower delimiting plane of the middle supporting part 6, and consequently, of the base frame 2 of the supporting device 4, running through the undersides of the longitudinal beams 40, 42 of the middle supporting part 6. In this manner, the supporting device 2 may include only a slight overall height.

Figure 2:
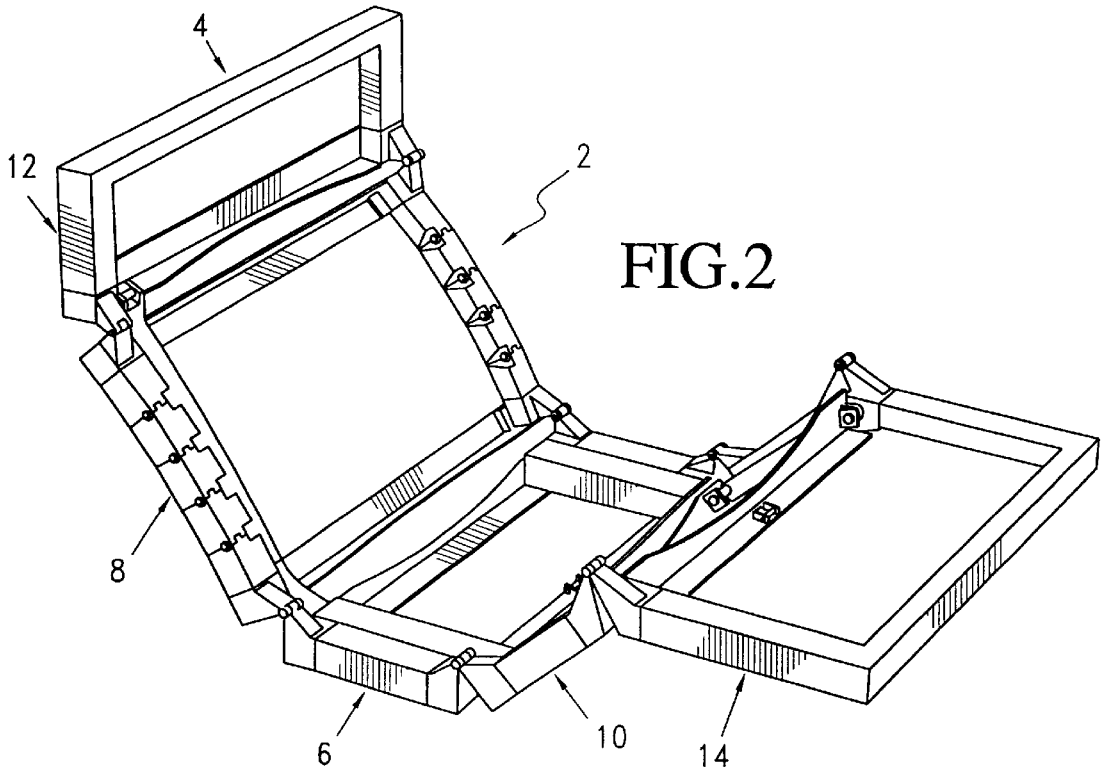
FIG. 2 shows on a smaller scale and the same perspective as in FIG. 1, the base frame according to FIG. 1, whereby the supporting parts are adjusted relative to one another.

FIG. 2 shows the supporting device according to FIG. 1, whereby the upper body supporting part 8 and the leg supporting part 10 relative to the middle supporting part 6, and the head supporting part 12 relative to the upper body supporting part 8, and the calf supporting part 14 relative to the leg supporting part 10, are adjusted.

The adjusting position of the supporting parts 6, 8, 10, 12, 14 illustrated in FIG. 1, corresponds to a lying position of a piece of furniture used for sitting and/or lying upon provided with the padding device according to the invention, not shown in the drawing, while the adjusting position of the supporting parts 6, 8, 10, 12, 14 shown in FIG. 2 corresponds to a sitting position of the piece of furniture used for sitting and/or lying upon.

The middle supporting part 6 may be attached to a substructure of the piece of furniture used for sitting and/or lying upon.

Figure 3:
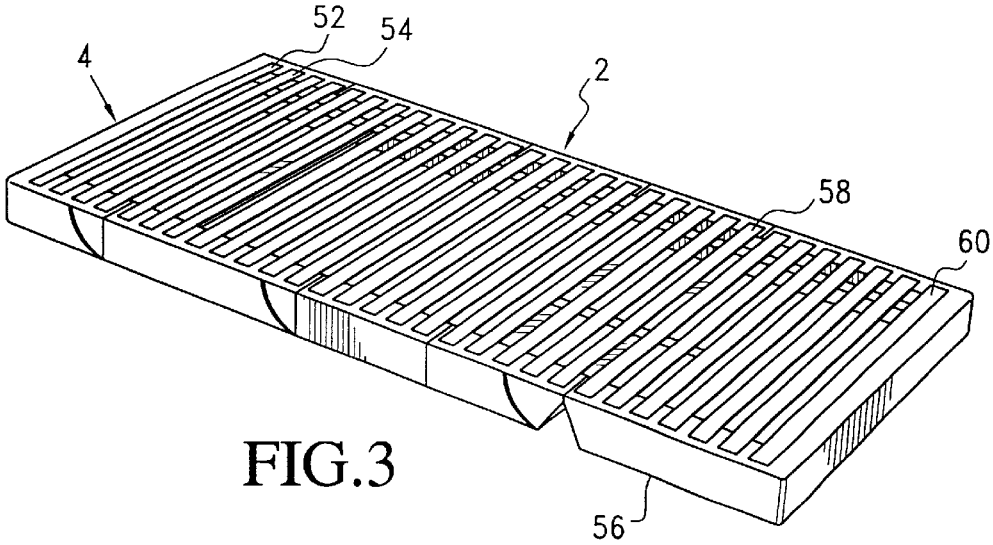
FIG. 3 shows in a schematic perspective view, the base frame with springy slats held thereto, whereby the supporting parts are not adjusted relative to one another.

FIG. 3 shows the supporting device 4, whereby in the longitudinal direction of the base frame 2, consecutive slats made of a springy material, for example, wood, are held. The slats, of which only two slats with the reference numbers 52, 54, are identified in FIG. 2, run in transverse direction to the supporting device 4.

The longitudinal beams 16–22, 28–34, and 40, 42 of the base frame 2 as well as the crossbars 24, 26 are wrapped with an elastic synthetic foam 56 in this embodiment, in such a way that an substantially even, circulating, elastic bearing area 58 for bearing a padding element of the padding device, not shown in FIG. 3, is formed.

Recesses at a distance to one another are formed in the bearing area 58 in the region of the longitudinal beams 16–22, 28–34, and 40, 42, of which only one recess with the reference number 60 is marked in FIG. 3 and which are formed substantially complementary to the free ends of the slats 52, 54. The slats 52, 54 catch into the recesses 60 with their free ends and are in such a way held in an interlocking manner in the recesses 60, which extend up to the longitudinal beams 16–22, 30–34 and 40, 42 so that the slats 52, 54 lie on the longitudinal beams 16–22, 28–34, and 40, 42.

FIG. 4 shows the supporting device 4 according to FIG. 3, whereby the supporting parts 6, 8, 10, 12, 14 are adjusted relative to one another by means of the linear driving gears 48, 50.

FIG. 5 shows the padding device 62 according to the invention. To attach a padding element, not recognizable in FIG. 5, in the form of a mattress, to form a unit with the supporting device 4 and the adjusting means, the mattress is laid on the bearing area 58 of the supporting device 4, and is glued thereto using an adhesive, so that the mattress is firmly attached to the supporting device 4 and the slats 52, 54 are securely held between the mattress and the base frame 2 of the supporting device 4.

The unit made of the supporting device 4 with the adjusting means and the mattress may include in this embodiment a casing 64, which in this embodiment is formed by a cover made of a textile material and which completely surrounds the unit.

The cover 64 may form holding means for holding the mattress to the supporting device 4, in such a way that the mattress is held to the supporting device 4 by means of the cover 64. It is then not necessary to glue the mattress to the supporting device 4.

It is not recognizable from the drawing, and it will therefore be explained here, that the cover 64 may include a continuous zipper in the region of the lower edge 66 of the padding device 62, such that a sealable opening is formed, through which the adjusting means are accessible. This facilitates the maintenance of the adjusting means or the replacement of its parts in the event of a defect.

Figure 6:
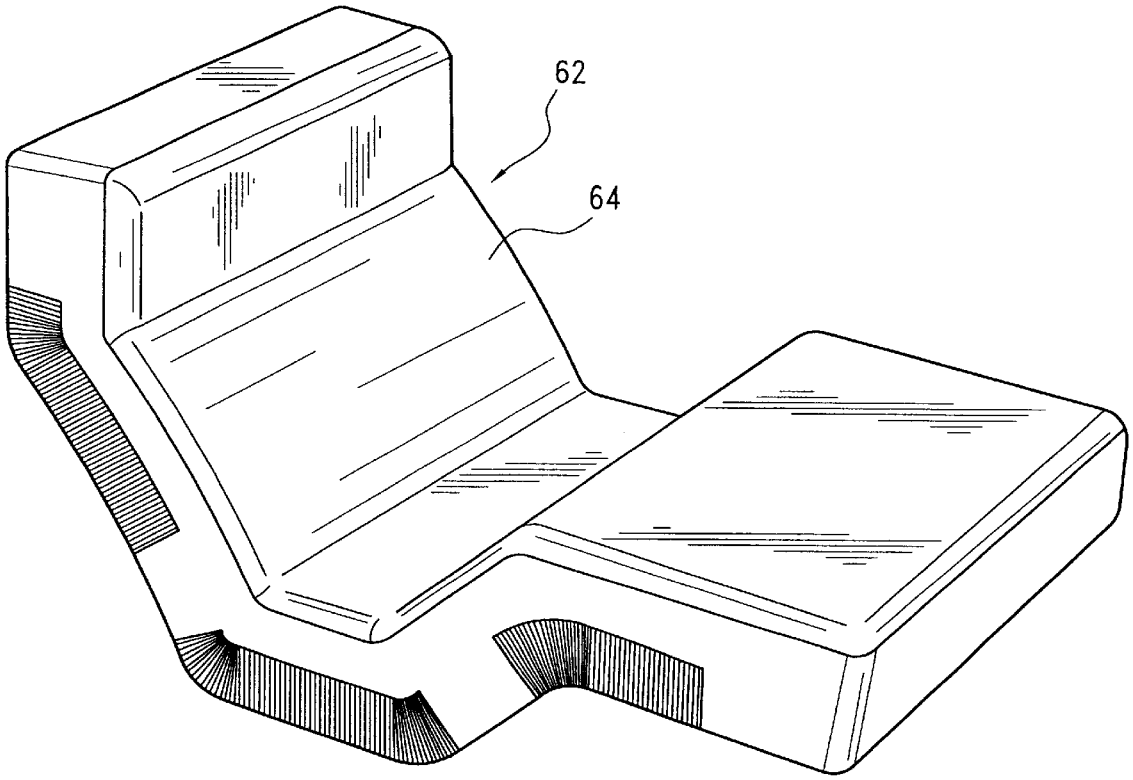
FIG. 6 shows in the same manner as in FIG. 5, the padding device according to FIG. 5, in which the supporting parts of the supporting device are adjusted relative to one another in a manner corresponding to FIG. 4.

FIG. 6 shows the padding device 62, whereby the supporting parts 6, 8, 10, 12, 14 are adjusted relative to one another by means of the linear driving gears.

Figure 7:
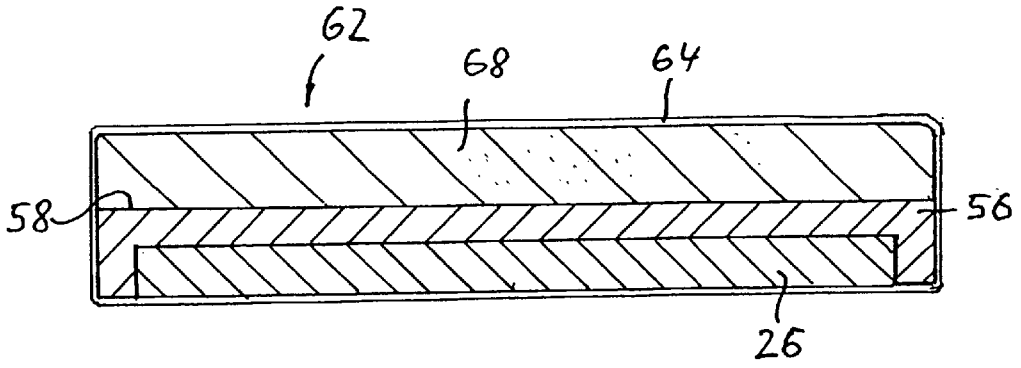
FIG. 7 is a section taken along a line VII—VII in FIG. 5.

FIG. 7 shows a section taken along a line VII—VII in FIG. 5. It may be seen that the crossbar 26 is wrapped with the synthetic foam 56 and the mattress 68 lies on the bearing area 58. The cover 64 completely surrounds the unit made of the supporting device 4 attached to the adjusting means and the mattress 68.

Figure 8:
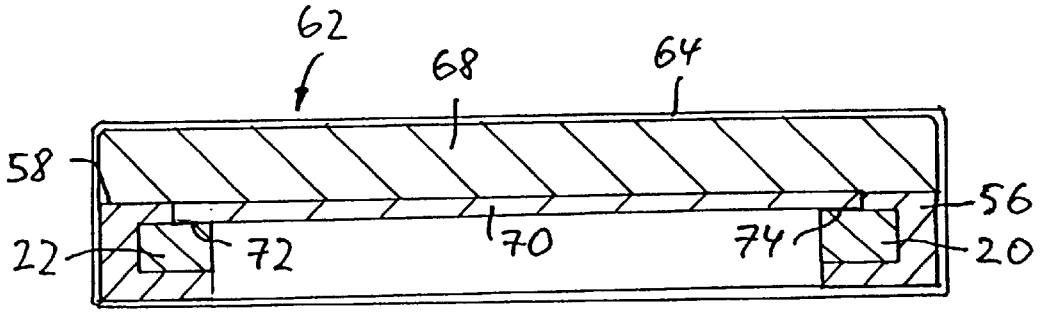
FIG. 8 is a section taken along a line VIII—VIII in FIG. 5.

FIG. 8 shows a section taken along a line VIII—VIII in FIG. 5. It may be seen that a slat 70 lies on the longitudinal beams 22, 20 and is held in the recesses 72, 74 formed in the bearing area 58 between the longitudinal beams 20, 22 and the mattress 68.

The padding device 62 according to the invention facilitates an excellent adaptation of the mattress 68 to the supporting device 4 so that a high degree of comfort is achievable for the user. For example, it is possible to make the mattress 68 relatively thin. In this manner, having the suspension properties of the slats 52 impaired by too thick a mattress is avoided. As a result, the comfort with respect to a conventional combination of a slatted frame with a mattress is substantially increased.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

What is claimed is:

1. An adjustable padding device for a piece of furniture used for one of sitting and lying upon, comprising:

a) at least one flat, elastically deformable padding element;

b) at least one adjustable supporting device, the adjustable supporting device including a base frame for flat support of the at least one deformable padding element;

c) the at least one padding element being attached to the supporting device to form a unit;

d) an electromotive adjusting element arranged on the supporting device for adjusting at least one part of the supporting device in one of its inclination and its height;

e) the electromotive adjusting element being integrated into the unit made of the at least one adjustable padding element and the supporting device; and f) the padding element with the supporting device and the adjusting element are accommodated in a common casing, which substantially completely surrounds the unit made of the padding element and the supporting device with the adjusting element.

2. Padding device according to claim 1, wherein:

a) the at least one padding element is detachably connected with the supporting device; and b) a holding element for holding the at least one padding element to the supporting device is provided.

3. Padding device according to claim 1, wherein:

a) the at least one padding element is firmly attached to the supporting device.

4. Padding device according to claim 3, wherein:

a) the at least one padding element is glued or foamed onto the supporting device.

5. Padding device according to claim 1, wherein:

a) the adjusting element is arranged substantially completely between an upper delimiting plane and a lower delimiting plane of the supporting device.

6. Padding device according to claim 1, wherein:

a) the adjusting element includes at least one linear driving gear.

7. Padding device according to claim 1, wherein:

a) the base frame includes longitudinal beams offset at a distance relative to one another, crossbars in a longitudinal direction at its ends, and one of the longitudinal beams and the crossbars, on its side facing the padding element, including bearing areas made of an elastic material, on which the padding element lies.

8. Padding device according to claim 7, wherein:

a) the bearing areas are configured as strips.

9. Padding device according to claim 7, wherein:

a) the base frame of the supporting device includes on its side facing the padding element springy slats offset at a distance to one another on which the padding element lies.

10. Padding device according to claim 9, wherein:

a) recesses are formed in the bearing areas, into which the slats engage with their free ends.

11. Padding device according to claim 10, wherein:

a) the recesses are shaped in a substantially complementary manner to the free ends of the slats.

12. Padding device according to claim 9, wherein:

a) the areas of the free ends of the slats facing the padding element substantially align with the adjacent bearing areas.

13. Padding device according to claim 9, wherein:

a) the slats lie on the longitudinal beams of the base frame of the supporting device.

14. Padding device according to claim 7, wherein:

a) the elastic material is a synthetic foam.

15. Padding device according to claim 14, wherein:

a) at least one of the longitudinal beams and the crossbeams are wrapped partially with the synthetic foam.

16. Padding device according to claim 1, wherein:

a) the base frame of the supporting device includes a first supporting part and at least a second supporting part for flat support of the padding element, the first supporting part and the second supporting part being attached to one another with a hinge and being pivotable relative to one another through the adjusting means.

17. Padding device according to claim 16, wherein:

a) the first supporting part is formed by a middle supporting part and the second supporting part is formed by an upper body supporting part, and a leg supporting part is provided, which is attached with a hinge to the middle supporting part on its side away from the upper body supporting part and is attached pivotably around a swivel pin substantially parallel to the swivel pin of the upper body supporting part.

18. Padding device according to claim 17, wherein:

a) a head supporting part is provided, which is attached with a hinge to the upper body supporting part on its side away from the middle supporting part and is attached pivotably around a swivel pin substantially parallel to the swivel pin of the head supporting part.

19. Padding device according to claim 17, wherein:

a) a calf supporting part is provided, which is attached with a hinge to the leg supporting part on its side away from the middle supporting part and is attached pivotably around a swivel pin substantially parallel to the swivel pin of the leg supporting part.

20. Padding device according to claim 1, wherein:

a) the casing includes at least one sealable opening, such that the adjusting element is accessible through the at least one opening.

21. Padding device according to claim 20, wherein:

a) the at least one opening is sealable by one of a zipper and a hook-and-loop fastener.

22. Padding device according to claim 1, wherein:

a) the casing is formed by a cover made of a textile material.

23. Padding device according to claim 1, wherein:

a) the padding element is a mattress.

* * * * *